US007398680B2

(12) United States Patent
Glasbergen et al.

(10) Patent No.: US 7,398,680 B2
(45) Date of Patent: Jul. 15, 2008

(54) TRACKING FLUID DISPLACEMENT ALONG A WELLBORE USING REAL TIME TEMPERATURE MEASUREMENTS

(75) Inventors: Gerard Glasbergen, Gouda (NL); Diederik van Batenburg, Delft (NL); Mary Van Domelen, Katy, TX (US); David O. Johnson, Spring, TX (US); Jose Sierra, Katy, TX (US); David Ewert, Bakersfield, CA (US); James Haney, Bakersfield, CA (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 11/398,483

(22) Filed: Apr. 5, 2006

(65) Prior Publication Data

US 2007/0234788 A1 Oct. 11, 2007

(51) Int. Cl.
*E21B 47/06* (2006.01)

(52) U.S. Cl. ..... 73/152.12; 374/136

(58) Field of Classification Search ..... None
See application file for complete search history.

(56) References Cited

U.S. PATENT DOCUMENTS

| | | | | |
|---|---|---|---|---|
| 3,480,079 | A | 11/1969 | Guinn et al. | |
| 3,864,969 | A * | 2/1975 | Smith, Jr. | 73/152.13 |
| 4,330,037 | A | 5/1982 | Richardson et al. | |
| 4,410,041 | A | 10/1983 | Davies | |
| 4,520,666 | A | 6/1985 | Coblentz | |
| 4,575,260 | A * | 3/1986 | Young | 374/136 |
| 4,641,028 | A * | 2/1987 | Taylor et al. | 250/266 |
| 4,832,121 | A | 5/1989 | Anderson | |
| 4,976,142 | A | 12/1990 | Perales | |
| 5,163,321 | A | 11/1992 | Perales | |
| 5,509,474 | A * | 4/1996 | Cooke, Jr. | 166/64 |
| 6,004,639 | A | 12/1999 | Quigley et al. | |
| 6,041,860 | A | 3/2000 | Nazzal et al. | |
| 6,082,454 | A | 7/2000 | Tubel | |
| 6,281,489 | B1 | 8/2001 | Tubel et al. | |
| 6,408,943 | B1 | 6/2002 | Schultz et al. | |

(Continued)

FOREIGN PATENT DOCUMENTS

| | | |
|---|---|---|
| EP | 1355166 | 10/2003 |

(Continued)

OTHER PUBLICATIONS

SPE 79080, Brown, George A., "Optical Fiber Sensors in Upstream Oil & Gas", dated 2002.

(Continued)

*Primary Examiner*—Robert R Raevis
(74) *Attorney, Agent, or Firm*—Marlin R. Smith

(57) ABSTRACT

Tracking fluid displacement along a wellbore using real time temperature measurements. A method of tracking fluid displacement along a wellbore includes the steps of: monitoring temperature in real time in the wellbore; and observing in real time a variation in temperature gradient between fluid compositions in the wellbore. Another method of tracking fluid displacement along a wellbore includes the steps of: monitoring temperature along the wellbore; and observing a variation in temperature gradient due to a chemical reaction in the wellbore. Another method includes the step of causing a variation in temperature gradient in the fluid while the fluid flows in the wellbore.

12 Claims, 7 Drawing Sheets

U.S. PATENT DOCUMENTS

| | | | |
|---|---|---|---|
| 6,437,326 | B1 | 8/2002 | Yamate |
| 6,531,694 | B2 | 3/2003 | Tubel et al. |
| 6,557,630 | B2 | 5/2003 | Harkins et al. |
| 6,588,266 | B2 | 7/2003 | Tubel et al. |
| 6,789,621 | B2 | 9/2004 | Metzel et al. |
| 6,828,547 | B2 | 12/2004 | Tubel et al. |
| 6,920,395 | B2 | 7/2005 | Brown |
| 6,977,367 | B2 | 12/2005 | Tubel et al. |
| 6,978,832 | B2 | 12/2005 | Gardner et al. |
| 6,981,549 | B2 | 1/2006 | Morales |
| 6,992,048 | B2 | 1/2006 | Reddy |
| 6,997,256 | B2 | 2/2006 | Williams et al. |
| 7,000,696 | B2 | 2/2006 | Harkins |
| 7,040,390 | B2 | 5/2006 | Tubel et al. |
| 7,055,604 | B2 | 6/2006 | Jee et al. |
| 7,086,484 | B2 | 8/2006 | Smith, Jr. |
| 7,140,435 | B2 | 11/2006 | Defretin et al. |
| 7,140,437 | B2 | 11/2006 | McMechan et al. |
| 2003/0166470 | A1 | 9/2003 | Fripp et al. |
| 2003/0205083 | A1 | 11/2003 | Tubel et al. |
| 2004/0040707 | A1 | 3/2004 | Dusterhoft |
| 2004/0084180 | A1 | 5/2004 | Shah |
| 2005/0149264 | A1 | 7/2005 | Tarvin et al. |

FOREIGN PATENT DOCUMENTS

| | | | |
|---|---|---|---|
| EP | 1357401 | | 10/2003 |
| EP | 1355169 | * | 12/2003 |
| GB | 2362462 | | 11/2001 |
| GB | 2364380 | | 1/2002 |
| GB | 2364381 | | 1/2002 |
| GB | 2364384 | | 1/2002 |
| GB | 2386625 | | 9/2003 |
| GB | 2397648 | | 7/2004 |
| GB | 2408327 | | 5/2005 |
| GB | 2408328 | | 5/2005 |
| GB | 2408329 | | 5/2005 |
| GB | 2408531 | | 6/2005 |
| SU | 1294985 | * | 3/1987 |
| WO | WO 98/50681 | | 11/1998 |
| WO | WO 2004/020789 | | 3/2004 |
| WO | WO 2004/020790 | | 3/2004 |
| WO | WO 2004/085795 | | 10/2004 |
| WO | WO 2004/114487 | | 12/2004 |
| WO | WO 2005/035943 | | 4/2005 |
| WO | WO 2005/064117 | | 7/2005 |
| WO | WO 2005/116388 | | 12/2005 |

OTHER PUBLICATIONS

SPE 10081, Fagley, John, et al., "An Improved Simulation for Interpreting Temperature Logs in Water Injection Wells", dated Oct. 1982.
SPE 87631, Johnson, D.O., et al., "Identification of Steam-Breakthrough Intervals with DTS Technology", dated 2004.
SPE 90541, Ouyang, Liang-Biao, et al., "Flow Profiling by Distributed Temperature Sensor (DTS) System—Expectation and Reality", dated 2006.
Ikeda, "Fractured Reservoir Management by Fiber Optic Distributed Temperature Measurement", dated Sep. 2000.
SPE 90130, "Use of a Fiber Optic Pressure/Temperature Guage in an Exploration Well to Minimize Formation Damage Potential and Reduce Costs During Production Testing", Bond et al., 2004.
SPE 90037, "Field Qualification of Four Multiphase Flowmeters on North Slope, Alaska", Hasebe, et al; dated 2004.
SPE 23147, "Fibre Optic Well Monitoring System", Bjornstad, et al; dated 1991.
SPE 16916, "Study of the Effects of Fluid Rheology on Minifrac Analysis", Lee; dated 1987.
SPE 15370, "Technique for Considering Fluid Compressibility and Temperature Changes in Mini-Frac Analysis", Soliman; dated 1986.
SPE 15308, "The Use of Microcomputers in Well Test Data Acquisition and Analysis", Horne et al; dated 1986.
SPE 100617, "Real-Time Monitoring of Acid Stimulation Using a Fiber-Optic DTS System", Clanton et al; dated 2006.
SPE 97912, "Fiber-Optic Distributed-Temerature-Sensing Technology Used for Resoervoir Monitoring in an Indoneasia Streamflood", Nath et al, dated 2005.
SPE 97023, "Injectivity Profiling in Horizontal Wells via Distributed Temperature Monitoring", Pimenov et al, dated 2005.
SPE 96260, "Interpretation of Distributed Temperature Data During Injection Period in Horizontal Wells", GAO et al, dated 2005.
SPE 95656, "A Comprehensive Model of Temperature Behavior in a Horizontal Well", Yoshioka, et al; dated 2005.
SPE 94989, "Slickline With Fiber-Optic Distributed Temperature Monitoring for Water-Injection and Gas Lift Systems Optimization in Mexico", Brown, et al.; dated 2005.
SPE 94695, "Field Validation of Acidizing Wormhole Models", Glasbergen, et al; dated 2005.
SPE 93240, "Fiber Optics Used to Support Reservoir Temperature Surveillance in Duri Steamflood", Nath; dated 2005.
SPE 89405, "A Successful Experience for Fiber Optic and Water Shut Off on Horizontal Wells with Slotted Liner Completion in an Extra Heavy Oil Field", Foucault, et al; dated 2004.
SPE 84379, "Monitoring Horizontal Producers and Injectors During Cleanup and Production Using Fiber-Optic-Distributed Temperature Measurements", Brown, et al; dated 2003.
SPE 77682, "Fiber Optic Monitoring in Openhole Gravel Pack Completions", Corbett, et al; dated 2002.
SPE 76724, Integrated Modeling of a Field of Wells—An Evaluation of Western Shallow Oil Zone Completion Practices, Elk Hills Field, Kern Co., California, Callison, et al.; dated 2002.
SPE 71829, "Fibre Optic Sensing—Case of Solutions Looking for Problems'", Eriksson; dated 2001.
SPE 54599, "Fiber Optic Temperature Monitoring Technology", Carnahan, et al; dated 1999.
SPE 54104, "Monitoring Streamflood Performance through Fiber Optic Temperature Sensing", Saputelli, et al; dated 1999.
SPE 35685, "A Field Trial to Test Fiber Optic Sensors for Downhole Temperature and Pressure Measurements, West Coalinga Field, California", Karaman, et al; dated 1996.
SPE 28484, "Electronic, Fiber-Optic Technology; Future Options for Permanent Reservoir Monitoring", Botto, et al; dated 1994.
SPE 25892, Field Implementation of Proppant Slugs to Avoid Premature Screen-Out of Hydraulic Fractures with Adequate.

* cited by examiner

TRACKING FLUID DISPLACEMENT ALONG A WELLBORE USING REAL TIME TEMPERATURE MEASUREMENTS

BACKGROUND

The present invention relates generally to operations performed and equipment utilized in conjunction with a subterranean wellbore and, in an embodiment described herein, more particularly provides a method of tracking fluid displacement along a wellbore using real time temperature measurements.

In well production and injection operations, it is known to use a distributed temperature survey (DTS) to sense temperature along a wellbore. For example, in stimulation operations a temperature profile may be generated after the operation is completed, and the temperature profile may be used to determine where the injected fluid entered formations or zones intersected by a wellbore. This information is useful in evaluating the effectiveness of the stimulation operation, and in planning future stimulation operations in the same, or a different, wellbore.

Unfortunately, these methods do not provide an operator with the information needed in real time, while the operation is progressing, to evaluate how the operation could be modified to improve the results of the operation. In addition, these methods rely on detecting temperature variations which are limited by various factors, including the difference between surface and downhole temperatures, properties of the fluids flowed in the wellbore, etc.

Therefore, it may be seen that improvements are needed in the art of tracking fluid displacement in a wellbore. It is among the objects of the present invention to provide such improvements, which may be useful in various operations, including but not limited to production, injection, stimulation, completion, testing, fracturing, conformance, etc.

SUMMARY

In carrying out the principles of the present invention, a method is provided which solves at least one problem in the art. One example is described below in which fluid properties are varied to thereby provide a detectable temperature gradient change for tracking fluid displacement. Another example is described below in which a chemical reaction is used to provide an enhanced temperature gradient difference in a wellbore.

In one aspect of the invention, a method of tracking fluid displacement along a wellbore is provided. The method includes the steps of: monitoring temperature in real time in the wellbore; and observing in real time a variation in temperature gradient between fluid compositions in the wellbore.

Another aspect of the invention includes a method of tracking fluid displacement along a wellbore, in which temperature is monitored along the wellbore. A variation in temperature gradient due to a chemical reaction in the wellbore is observed.

Yet another aspect of the invention includes a method of tracking fluid displacement along a wellbore, in which a variation in temperature gradient in the fluid is produced while the fluid flows in the wellbore. The variation in temperature gradient may be caused by varying a physical property of the fluid, varying or initiating a chemical reaction, varying a Joule-Thomson effect in the fluid, varying a density, specific heat and/or product of density and specific heat of the fluid, varying a viscosity of the fluid, varying a flow rate of the fluid, varying a gas proportion of the fluid, varying a friction pressure in the fluid, variably increasing or decreasing temperature of the fluid, varying proportions of fluid compositions and/or substances in the fluid, variably applying a magnetic field or electric potential in the fluid, or otherwise producing different temperature gradients in the fluid. A switchable temperature gradient modifier may be used to selectively change the temperature gradient of the fluid.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
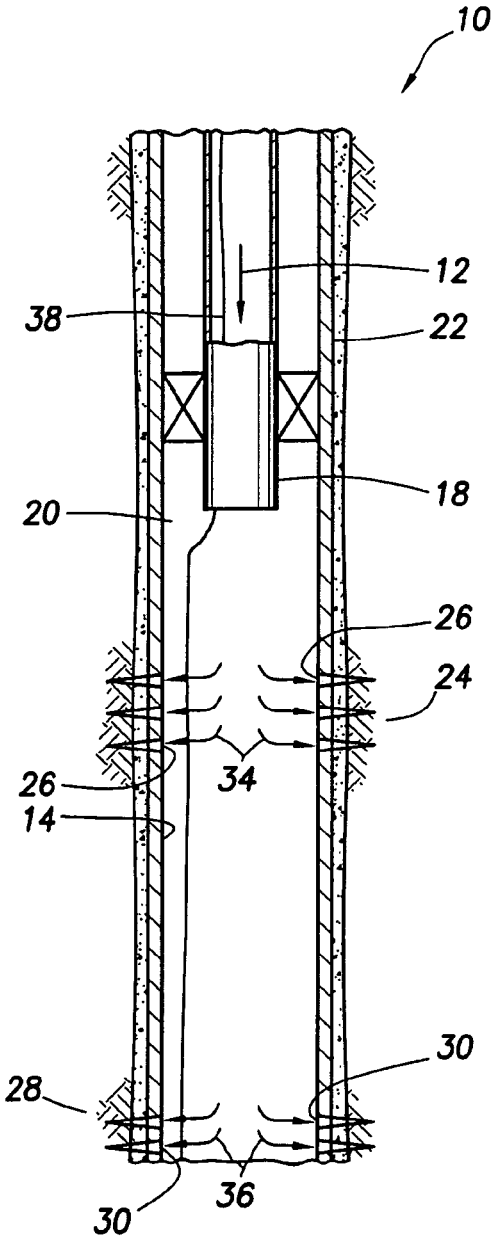
FIG. 1 is a partially cross-sectional schematic view of a method of tracking fluid displacement along a wellbore, the method embodying principles of the present invention.

Representatively illustrated in FIG. 1 is a method 10 which embodies principles of the present invention. As depicted in FIG. 1, fluid 12 is injected into a wellbore 14 via a production tubing string 18, and then into an area 20 of the wellbore below a packer set in a casing string 22. Although the area 20 is depicted as being cased, in other embodiments of the invention the area could be uncased.

Eventually, the fluid 12 flows into a formation, strata or zone 24 via perforations 26. If desired, the fluid 12 may also be flowed into another formation, strata or zone 28 via separate perforations 30. The zones 24, 28 could be isolated from each other in the wellbore 14 by a packer set in the casing string 22, if desired.

In this manner, a portion 34 of the fluid 12 flows into the upper zone 24, and another portion 36 flows into the lower zone 28. One problem solved by the method 10, as described more fully below, is how to determine in real time how much of the fluid 12 has flowed and is flowing into each of the zones 24, 28. Another problem solved by the method 10 and described more fully below is how to track the fluid 12 (including its various stages) in real time as it displaces along the wellbore 14.

In the past, DTS systems utilizing an optical conductor 38 (such as an optical fiber in a small diameter tube, or incorporated into a cable, etc.) have been used to produce a temperature profile along the wellbore 14. After the injection operation, the temperature profile from before the operation would be compared to the temperature profile from during the operation, and/or after a "warmback" period, in order to determine where the fluid 12 entered the various zones 24, 28 and how much of the fluid entered each zone. However, these past methods do not allow the fluid 12 to be tracked in real time, so that the injection operation can be evaluated and modified if desired during the operation.

At this point it should be noted that the invention is not limited in any way by the details of the method 10 described herein or the configuration of the well as illustrated in FIG. 1. For example, the invention is not necessarily used only in injection operations, since it may also be used in other types of operations (such as production, stimulation, completion, etc. operations). The invention is not necessarily used only in cased wellbores, since it may also be used in uncased wellbores. The invention is not necessarily used only where multiple zones have fluid transfer with a wellbore. A coiled tubing string could be used in addition to, or instead of, a production tubing string to transfer fluid to or from a wellbore. It is not necessary for an optical conductor to be used to monitor temperature along a wellbore. Therefore, it should be clearly understood that the method 10 is described and illustrated herein as merely one example of an application of the principles of the invention, which is not limited at all to the details of the described method.

Figure 2:
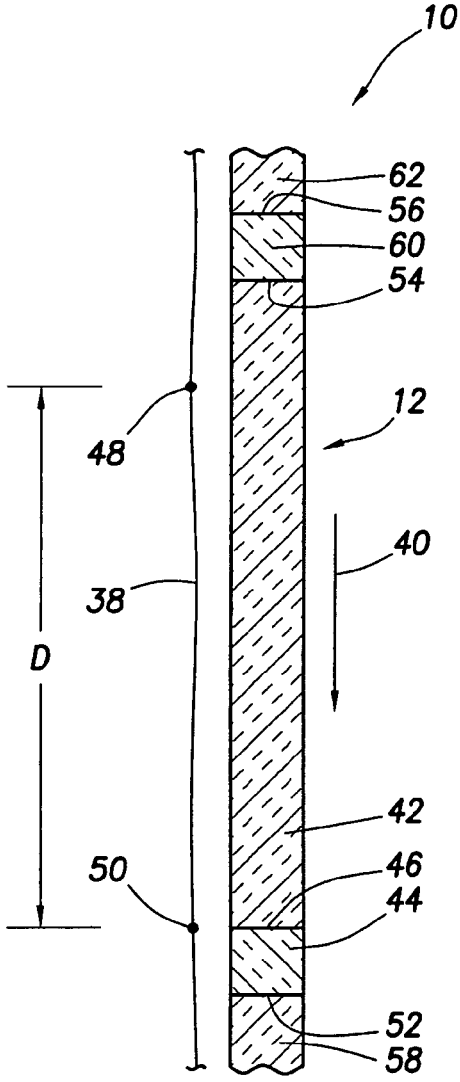
FIG. 2 is an enlarged scale schematic view of fluid displacement relative to an optical conductor in the method of FIG. 1.

Referring additionally now to FIG. 2, a schematic view of a column of the fluid 12 and the adjacent optical conductor 38 are representatively illustrated apart from the remainder of the well configuration of FIG. 1. As depicted in FIG. 2, the column of the fluid 12 is displacing in a downward direction in the wellbore 14, as indicated by the arrow 40. Of course, the fluid 12 could displace upward, horizontally, or in any other direction in keeping with the principles of the invention. In addition, although the column of fluid 12 is depicted as being separated from the optical conductor 38, it will be appreciated that the optical conductor could instead be in direct contact with the fluid, immersed in the fluid, opposite a barrier from the fluid or otherwise positioned relative to the fluid.

It is desired in the method 10 to track displacement of a fluid composition 42 in the wellbore 14 in real time. The fluid composition 42 would sometimes be referred to by those skilled in the art as a "stage" of the injection operation. The fluid composition 42 could, for example, be an acidizing treatment fluid, a fracturing fluid, a proppant slurry, a gel, a diverting agent, a completion fluid, a cleanout treatment, etc.

In one important feature of the method 10, another fluid composition 44 is flowed adjacent to the fluid composition 42, so that an interface 46 is created between the fluid compositions. The fluid composition 44 could be referred to by those skilled in the art as a "slug" or another stage of the injection operation. In this feature of the method 10, the fluid composition 44 has a substantially different physical property, or at least a substantially different rate of heat transfer with the environment of the wellbore 14, as compared to the fluid composition 42.

Due to the substantially different physical properties and rates of heat transfer between the fluid compositions 42, 44 and the wellbore 14, a variation in temperature gradient occurs in the wellbore as the interface 46 displaces through the wellbore. By observing in real time the position and displacement of the temperature gradient change, the corresponding position, displacement and flow rate of the fluid 12 and its fluid compositions 42, 44 may be determined.

For example, using the optical conductor 38 the temperature in the wellbore 14 at a location 48 in the wellbore along the optical conductor can be detected. The temperature at the location 48 may be monitored in real time. An acceptable system for real time monitoring of temperature in the wellbore 14 is the OPTOLOG® DTS system available from Halliburton Energy Services of Houston, Tex. USA.

It will be appreciated by those skilled in the art that when the fluid composition 44 is positioned adjacent the location 48 a different temperature gradient will be detected as compared to the temperature gradient when the fluid composition 42 is positioned adjacent the location 48. Thus, as the interface 46 displaces past the location 48, a variation in temperature gradient will be detected. This temperature gradient variation will indicate that the fluid composition 42 has arrived at the location 48. In this manner, the position of the fluid composition 42 may be conveniently tracked using the method 10.

Using a DTS system, or another system capable of detecting temperature at multiple locations, the temperature at another location 50 may also be monitored. As depicted in FIG. 2, the location 50 is along the optical conductor 38 and the interface 46 is passing the location 50 as it displaces downward. Thus, a variation in temperature gradient will be detected at the location 50 as the interface 46 passes the location by monitoring the temperature at the location in real time. Again, the position of the fluid composition 42 is indicated by this temperature gradient variation.

The velocity of the fluid composition 42 may be conveniently determined as a distance D between the locations 48, 50 divided by a difference in time between when the interface 46 passes the locations 48, 50. Multiplying the velocity by the cross-sectional area of the flow passage through which the fluid flows yields the volumetric flow rate of the fluid composition 42.

Again referring to FIG. 1, it will be appreciated that the method 10 permits the flow rate of the fluid 12 to be determined in real time at any location along the wellbore 14. Thus, the flow rate of the fluid 12 as it exits the tubing string 18, the flow rate of the fluid portion 34 which flows into the zone 24, and the flow rate of the fluid portion 36 which flows into the zone 28 may all be conveniently determined in real time using the method 10. In addition, the position of each of the fluid compositions 42, 44 along the wellbore 14 may be conveniently tracked in real time using the method 10.

Referring again to FIG. 2, note that any number of interfaces 46, 52, 54, 56 may be used between any corresponding number of fluid compositions 42, 44, 58, 60, 62. For example, by using the interfaces 46, 54 at either end of the fluid composition 42, the arrival and departure of the fluid composition at each of the locations 48, 50 may be conveniently monitored in real time.

In that case, the fluid composition 60 would preferably have a different physical property, or at least have a different rate of heat transfer with the environment of the wellbore 14, as compared to that of the fluid composition 42, similar to the manner described above for the fluid composition 44, although it is not necessary for the fluid compositions 44, 60 to be the same. Likewise, it is not necessary for the fluid compositions 44, 60 to be different fluid compositions.

In one possible application, the fluid compositions 44, 60 could be the same fluid composition or slug material which is injected periodically in the column of the fluid 12 to permit convenient tracking of the fluid through the wellbore 14. In that case, the fluid compositions 58, 62 positioned opposite the fluid compositions 44, 60 from the fluid composition 42 may be the same as the fluid composition 42.

Of course, the fluid compositions 58, 62 are not necessarily the same as the fluid composition 42, and are not necessarily the same as each other. For example, the fluid compositions 42, 58, 62 could each be a different stage in the injection operation, with the fluid compositions 44, 60 being injected as slugs between the stages in order to permit convenient tracking of the displacement of each stage through the wellbore 14.

As discussed above, the temperature gradient variation which is detected as each interface 46, 52, 54, 56 displaces past the locations 48, 50 is due to the different physical properties of the fluid compositions 42, 44, 58, 60, 62 on either side of the respective interfaces, or at least due to different rates of heat transfer between the fluid compositions and the environment of the wellbore 14. For example, the fluid composition 42 could have a specific heat which is substantially different from the specific heat of the fluid composition 44.

As another example, the fluid composition 42 could have a density which is substantially different from the density of the fluid composition 44. Preferably, a product of specific heat and density is substantially different between the fluid compositions 42, 44 in order to provide a sufficiently large temperature gradient variation as the interface 46 displaces past the locations 48, 50 so that the temperature gradient variation may be conveniently detected and tracked along the wellbore 14. A similar situation preferably also exists for the interfaces 52, 54, 56.

It will be appreciated that various combinations of fluid compositions on either side of an interface may be used to provide a substantially different product of specific heat and density across the interface. For example, a foam and a water based liquid, a gas and a liquid, an oil based liquid and a water based liquid, a fluid composition having a relatively large proportion of suspended particles and a fluid composition having a relatively small proportion of suspended particles, a fluid composition having a relatively large proportion of gas therein and a fluid composition having a relatively small proportion of gas therein, etc. are combinations of fluid compositions which can provide substantially different products of specific heat and density.

Another factor which can affect the rate of heat transfer between a fluid composition and the environment of the wellbore is flow rate. If one fluid composition is flowed relatively quickly into (or out of) the wellbore 14, and another fluid composition is flowed relatively slowly, there will be a difference in the rate of heat transfer between the wellbore environment and the fluid compositions.

Another physical property which may be used to produce different temperature gradients in fluid compositions is the Joule-Thomson effect. Joule-Thomson cooling occurs when a non-ideal gas expands from high to low pressure at constant enthalpy. Thus, if a gas (such as nitrogen, for example, in a foamed stage) is flowed through a restriction, Joule-Thomson cooling may occur as the gas expands. The Joule-Thomson effect often causes a temperature decrease as gas flows through pores of a reservoir to a wellbore.

However, the temperature change may be positive or negative due to the Joule-Thomson effect. For each gas there is an inversion point that depends on temperature and pressure, below which the gas is cooled, and above which the gas is heated. For example, for methane at 100° C., the inversion point occurs at about 500 atmospheres. The magnitude of the change of temperature with pressure depends on the Joule-Thomson coefficient for a particular gas.

Another physical property which may be used to produce different temperature gradients in fluid compositions is friction pressure. Increased friction is an increased source of heat in a flowing fluid, and reduced friction is a reduced source of heat. Thus, by changing friction pressure in flowing fluid compositions, different temperature gradients may be produced.

Another physical property which may be used to produce different temperature gradients in fluid compositions is viscosity. Increased viscosity in the fluid 12 will generally result in increased friction and, consequently, increased heat. For example, one manner of increasing viscosity would be to use a magnetorheological or electrorheological fluid composition and selectively apply a magnetic field or electric potential to the fluid composition to thereby increase its viscosity.

Figure 3:
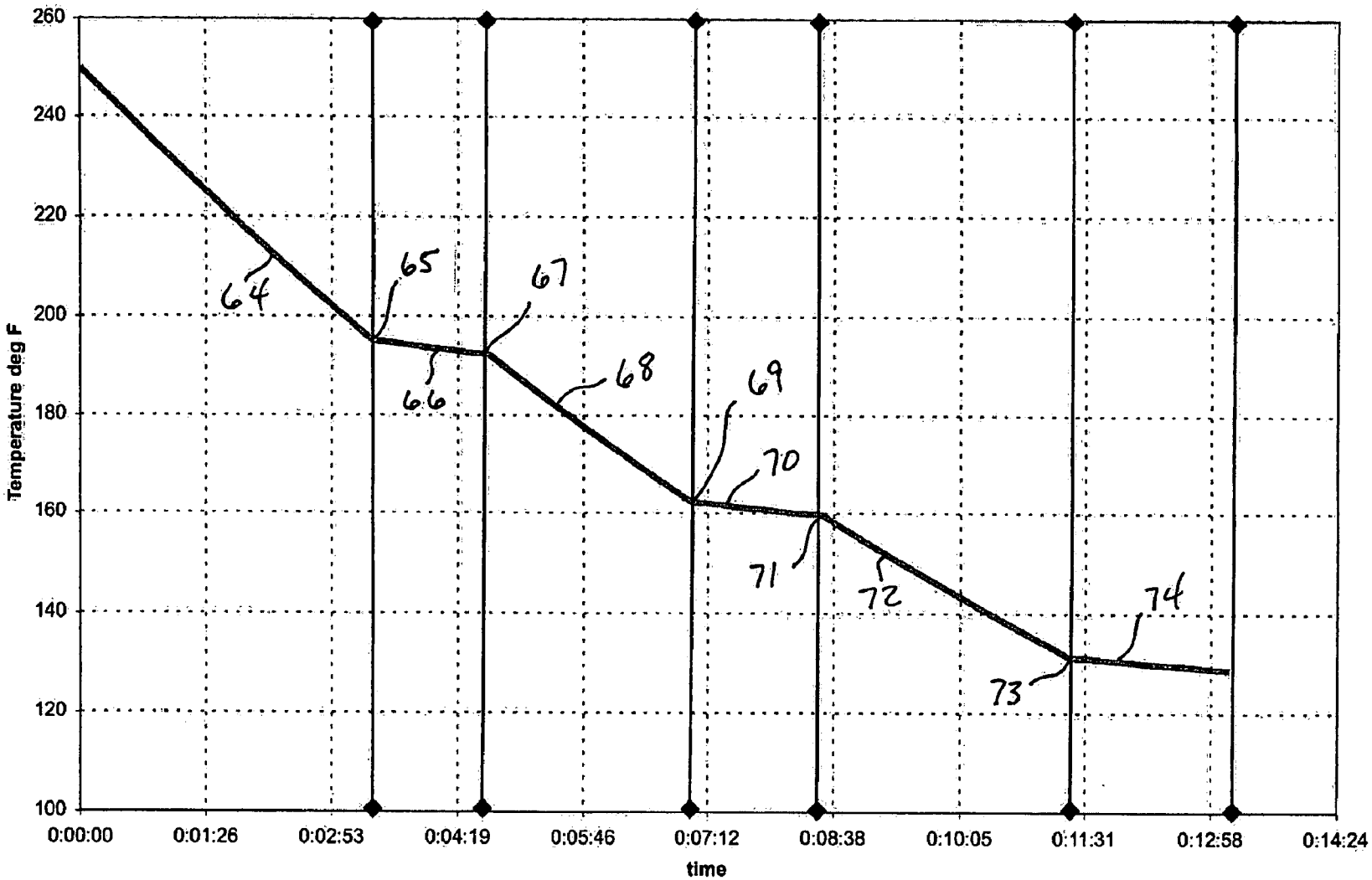
FIG. 3 is a graph of temperature versus time for an example of the method of FIG. 1.

Referring additionally now to FIG. 3, a graph is representatively illustrated of temperature over time at a location in the wellbore 14. For example, the location could be either of the locations 48, 50 depicted in FIG. 2, or any other location in the wellbore 14.

Note that an initial temperature gradient 64 is substantially different from a later temperature gradient 66. As discussed above, this variation in temperature gradient is due to the different physical properties of the fluid compositions flowing past the location at which the temperature is monitored. Similarly, variations are seen between additional temperature gradients 68, 70, 72 and 74 in the graph of FIG. 3.

The temperature gradients 64, 66, 68, 70, 72 could be indicative of the respective fluid compositions 58, 44, 42, 60, 62 depicted in FIG. 2. In that case, changes in temperature gradient shown at points 65, 67, 69, 71 in the graph of FIG. 3 could be indicative of the respective interfaces 52, 46, 54, 56. The temperature gradient variation shown at point 73 in the graph could indicate an end of the fluid composition 62, and the beginning of another fluid composition.

Thus, it will be appreciated that by monitoring in real time the temperature at a location in the wellbore 14, temperature gradient variations over time may be detected, and these temperature gradient variations may be used to track the displacement of particular fluid compositions through the wellbore.

Figure 4:
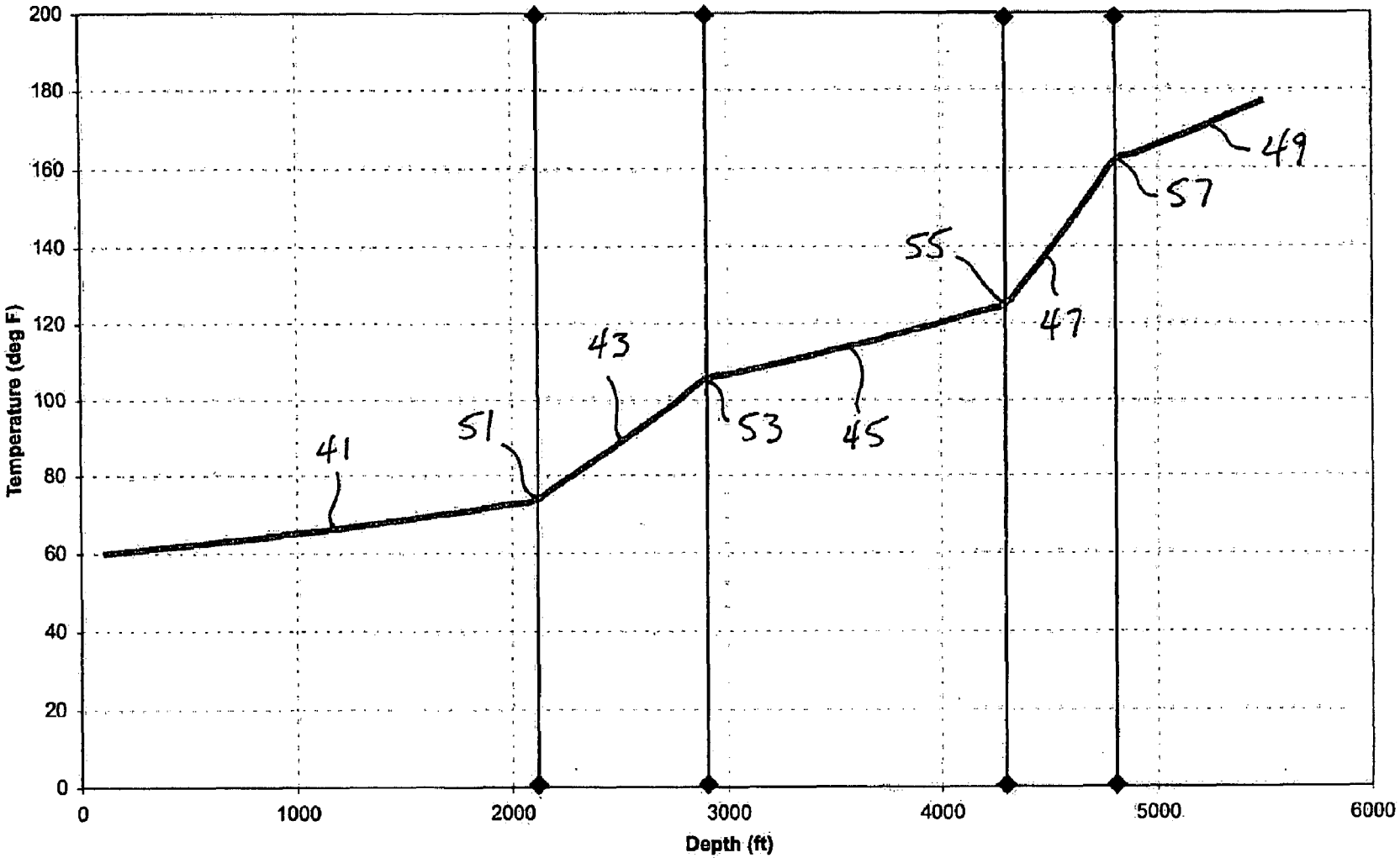
FIG. 4 is a graph of temperature versus depth for another example of the method of FIG. 1.

Referring additionally now to FIG. 4, another graph is representatively illustrated. Temperature gradient variations are depicted in FIG. 4, but the variations are shown over distance, instead of over time as in the graph of FIG. 3.

Using the optical conductor 38, the temperature along the wellbore 14 may be monitored in real time at any point along the optical conductor. FIG. 4 illustrates a temperature profile along the wellbore 14 at a particular point in time.

Note that a temperature gradient 41 in an upper portion of the wellbore 14 is different from a deeper temperature gradient 43, and that variations are also seen between sequentially deeper temperature gradients 45, 47, 49. The changes between the temperature gradients 41, 43, 45, 47, 49 are seen at points 51, 53, 55, 57.

The temperature gradients 41, 43, 45, 47, 49 could be indicative of the respective fluid compositions 62, 60, 42, 44, 58 of FIG. 2. In that case, the variations in temperature gradient seen at points 51, 53, 55, 57 would be indicative of the respective interfaces 56, 54, 46, 52.

Thus, it will be appreciated that by monitoring in real time the temperature along the wellbore 14, temperature gradient variations over distance may be detected, and these temperature gradient variations may be used to track the positions of particular fluid compositions along the wellbore.

The fluid compositions injected into a wellbore would typically have temperatures which are initially at or near the ambient surface temperature. As a fluid composition is flowed to greater depths, or otherwise is in the wellbore a longer period of time, the temperature of the fluid composition typically increases, with the rate of temperature increase being dependent on the physical properties of the fluid composition. By monitoring the variations in temperature gradient over time and over distance, the displacement and position of particular fluid compositions may be accurately tracked, thereby permitting the flow rate of each fluid composition, and the amount of each fluid composition which enters each zone 24, 28, to be determined.

Detection of a temperature gradient variation at an interface between fluid compositions may be enhanced by using a variety of techniques. For example, the temperature gradient of a fluid composition in a wellbore could be either increased or reduced by altering the temperature of the fluid composition either prior to or while the fluid composition is being injected into the wellbore. In this manner, the difference in temperature gradient between the fluid composition and another fluid composition on an opposite side of an interface may be increased for more convenient detection of the position of the interface.

Furthermore, the temperature gradient of a fluid composition could be varied while the fluid composition is being flowed in the wellbore by, for example, use of various endothermic or exothermic chemical reactions. FIGS. 5-8 depict a number of techniques whereby a temperature gradient change is produced in the wellbore 14 in the method 10, but it should be clearly understood that the principles of the invention are not limited to only the techniques specifically described herein, and the invention is not limited to the details of these techniques.

Figure 5:
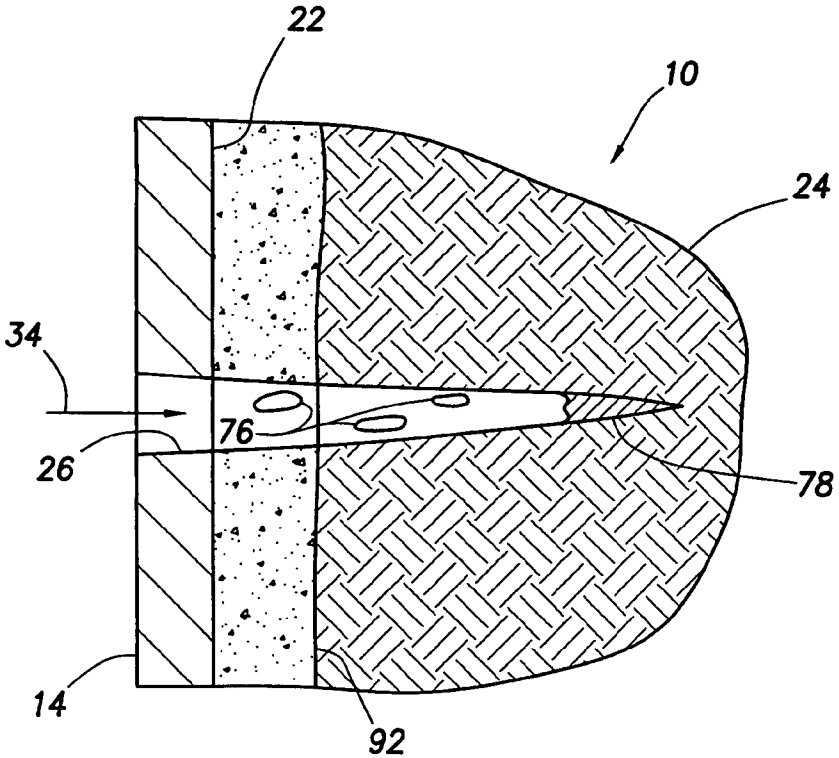

In FIG. 5, an enlarged scale cross-sectional view of one of the perforations 26 is representatively illustrated. As described above, a portion 34 of the fluid 12 enters the perforation 26 and flows into the zone 24 in the method 10.

In the technique depicted in FIG. 5, a substance 76 is deposited in the perforation 26. Later, a fluid composition contacts the substance and an exothermic or endothermic chemical reaction is thereby initiated, which produces a temperature change at the perforation 26. In this manner, the arrival of the fluid composition at the perforation 26 may be conveniently detected in real time in the method 10.

For example, the substance 76 could be aluminum, magnesium or calcium carbonate pellets pumped into the perforation 26 during a particular stage of an injection operation. Later, a stage which includes a fluid composition with hydrochloric acid therein could be flowed into the wellbore 14 so that, as the hydrochloric acid contacts the pellets, an exothermic chemical reaction is initiated.

A temperature increase will be detected in real time (for example, using the optical conductor 38) when the exothermic reaction is initiated, and thus the arrival of the fluid composition at the perforation 26 will be conveniently detected. If the substance 76 is positioned in multiple spaced apart perforations 26, 30, then the arrival of the fluid composition at each of the perforations can also be detected in real time.

Note that it is not necessary for the substance 76 to be deposited in the perforations 26, 30. The substance 76 could instead, or in addition, be deposited within the casing string 22, in the zone 24 (such as during drilling, completion or production operations), or anywhere else in the wellbore 14 and its surrounding environment. For example, a substance 78 could be deposited in the zone 24 when perforating charges are detonated to form the perforations 26. As another example, the substance 76 could be mixed in with cement 92 lining the wellbore.

The substance 76 could be provided with a coating, so that a particular fluid composition must contact the coating in order to initiate the chemical reaction. One fluid composition may be used to disperse or penetrate the coating, and then another fluid composition may be used to contact the substance 76 to initiate the chemical reaction.

Figure 6:
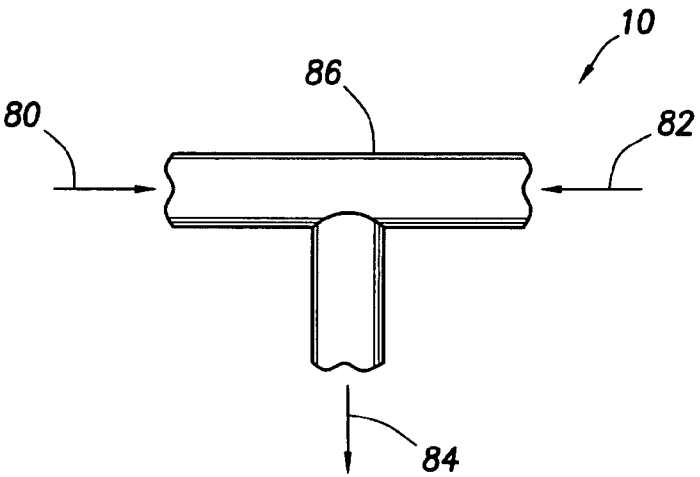
FIGS. 5-8 are schematic views of techniques for initiating a chemical reaction in the method of FIG. 1.

In FIG. 6, different fluid compositions 80, 82 are mixed together at a manifold 86 at the surface prior to flowing the mixed fluid composition 84 into the wellbore 14. For example, the fluid composition 80 could include hydrochloric acid, and the fluid composition 82 could include anhydrous or aqueous ammonia, or calcium carbonate. When the fluid compositions 80, 82 are mixed, an exothermic chemical reaction is initiated, thereby permitting enhanced detection of the mixed fluid composition 84 along the wellbore 14.

Figure 7:
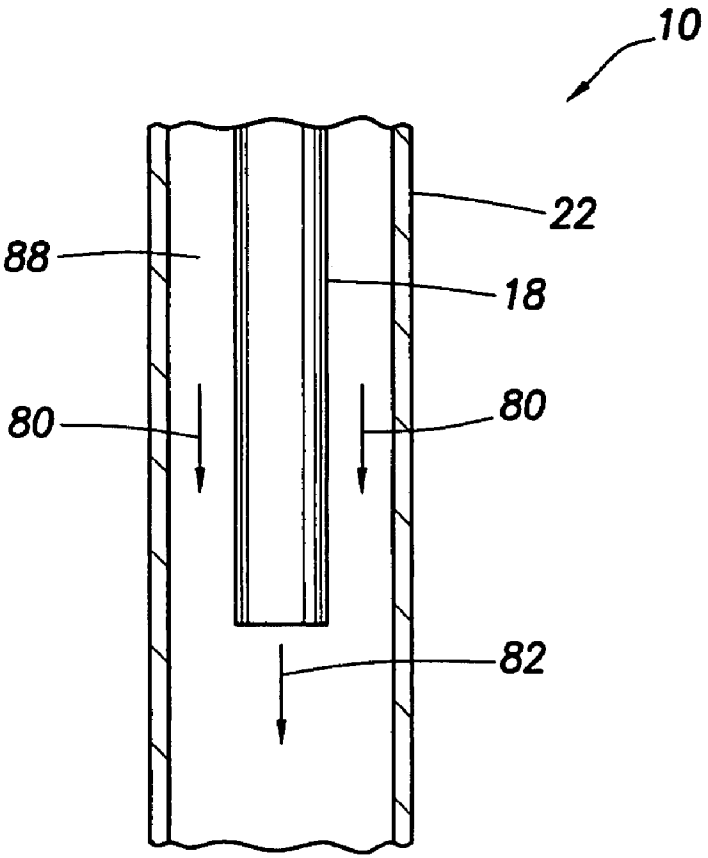

In FIG. 7, the different fluid compositions 80, 82 are mixed together in the wellbore 14. For example, the fluid composition 82 could be flowed into the wellbore via the tubing string 18, and the fluid composition 80 could be flowed into the wellbore via an annulus 88 formed between the tubing string and the casing string 22. When the fluid compositions 80, 82 are mixed downhole, an exothermic chemical reaction is initiated, thereby permitting enhanced detection of the mixed fluid composition 84.

Figure 8:
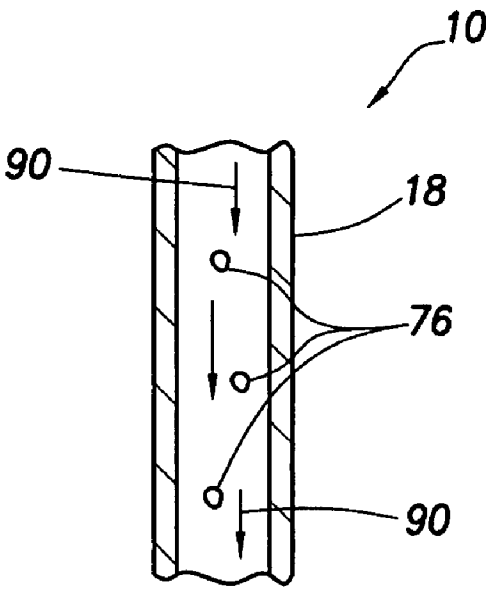

In FIG. 8, the substance 76 is flowed into the wellbore 14 along with a fluid composition 90. A chemical reaction results from contact between the fluid composition 90 and the substance 76 while they are flowing through the wellbore 14. A coating could be provided on the substance 76 to, for example, delay initiation of the chemical reaction.

It will be readily appreciated by those skilled in the art that many different chemical reactions could be initiated in many different ways to produce temperature gradient variations in the method 10. For example, any type of endothermic or exothermic reactions may be used, acid-base reactions may be used, dissolution reactions may be used (whether the substance being dissolved is naturally occurring, previously deposited or conveyed along with or after the dissolving agent, and whether the substance is deposited in a different operation), mixing of ionic liquids with downhole water may be used, etc.

Chemical reactions may also be used to produce temperature gradient variations by generating gas in a fluid composition. For example, there are chemical reactions which will result in gas being generated in a fluid composition, thereby altering the proportion of gas in the fluid composition. This altered gas proportion can be observed as a temperature gradient variation using the DTS system, thus permitting the displacement of the fluid composition to be monitored.

Chemical reactions which generate heat and/or gas in a fluid composition are described in U.S. Pat. Nos. 4,330,037, 4,410,041 and 6,992,048, the entire disclosures of which are incorporated herein by this reference. Another example of gas generation in a well is the production of $CO_2$ gas when acid is injected into formation rock.

Gas may be generated by any method in keeping with the principles of the invention, including but not limited to mixing multiple fluids together, contacting a substance with a fluid, etc. For example, fluids and/or substances may be mixed to produce chemical reactions for varying gas proportion in a fluid composition using any of the techniques depicted in FIGS. 5-8 and described above.

In addition, cooling effects may be produced using techniques other than chemical reactions, such as by flowing a fluid composition through a choke, restriction, nozzle or venturi. The choke, restriction, nozzle or venturi could be switchable, so that the cooling effect could be applied to selected fluid compositions or stages, and not to others. Other types of switchable heaters and/or coolers could be used in keeping with the principles of the invention. A change of state or phase could be used to produce a heating or cooling effect. The Joule-Thomson effect could be used to produce a heating or cooling of a fluid composition. A change in friction pressure may be used to produce a change in temperature gradient in flowing fluid compositions. It should be clearly understood that the invention encompasses any manner of selectively heating or cooling the fluid compositions and producing different temperature gradients, whether prior to, during or after the fluid compositions are flowed in the well.

Figure 9:
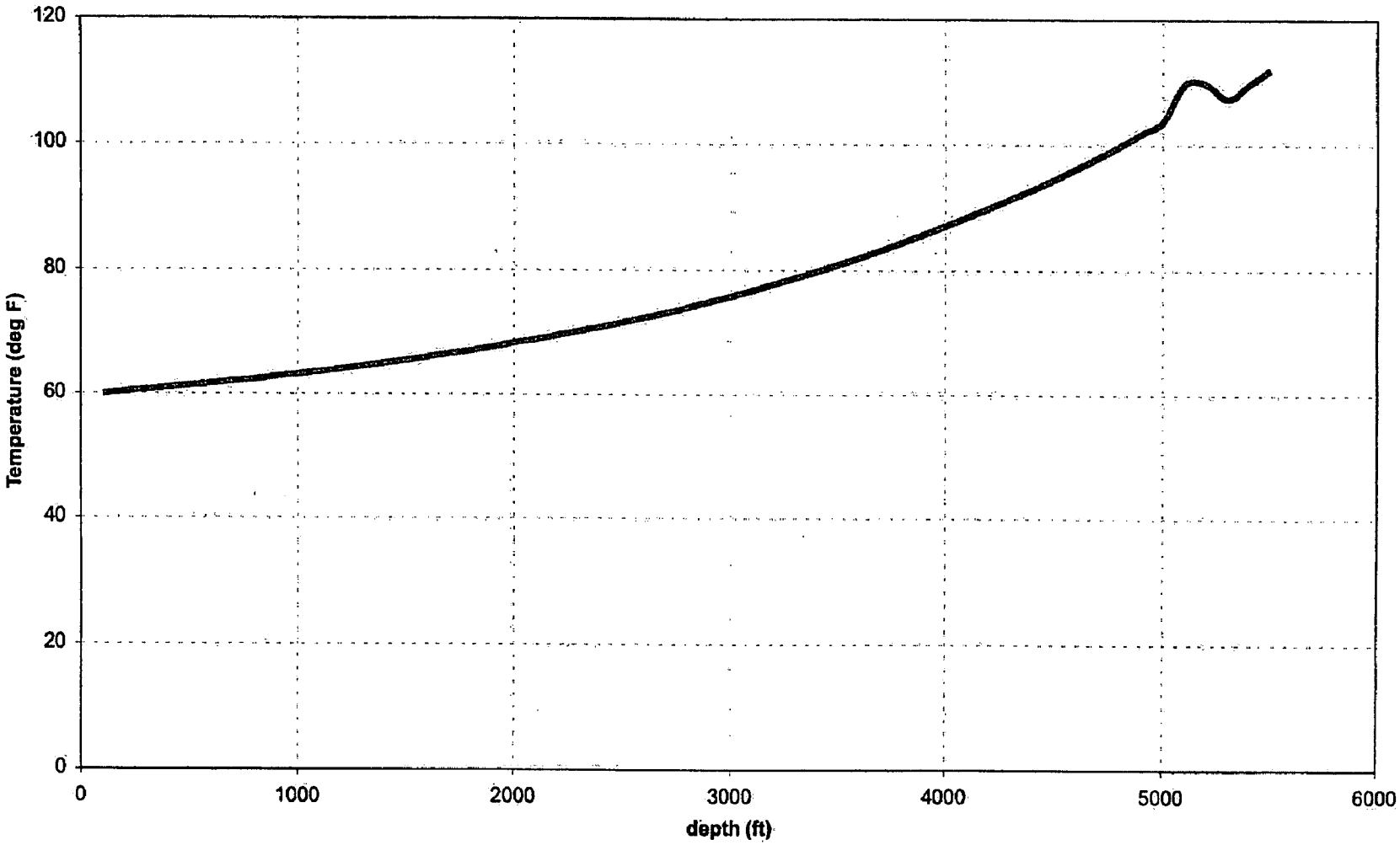
FIG. 9 is a graph of temperature versus depth for an example of the technique depicted in FIG. 5.

Referring additionally now to FIG. 9, a graph is representatively illustrated of temperature along the wellbore 14. In this graph a substantial change in temperature gradient is seen at a depth of approximately 5000 to 5250 ft. This indicates a localized temperature increase due, for example, to an exothermic reaction of the type described above. Endothermic reactions and other types of temperature changes may similarly be detected by monitoring temperature in real time along the wellbore 14.

Figure 10:
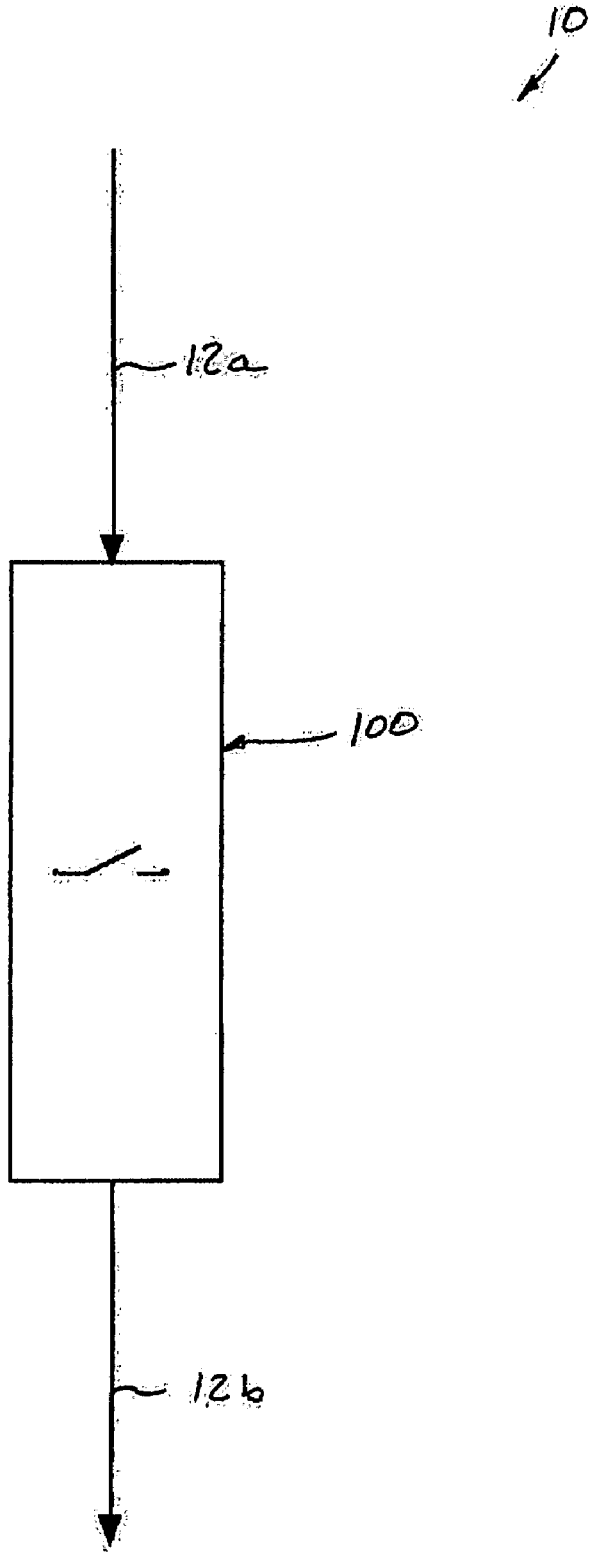
FIG. 10 is a schematic view of a temperature gradient modifier being used to change a temperature gradient of fluid in the method of FIG. 1.

Referring additionally now to FIG. 10, a schematic diagram of the fluid 12 flowing through a switchable temperature gradient modifier 100 is representatively illustrated. The fluid 12 prior to flowing through the temperature gradient modifier 100 is indicated in FIG. 10 as "12*a*," and the fluid after flowing through the temperature gradient modifier is indicated in FIG. 10 as "12*b*."

The temperature gradient modifier 100 is "switchable" in that it may be used to selectively modify the temperature gradient of the fluid 12 in one manner at one time, and in another manner at another time. Thus, the term "switchable" does not merely mean "on or off," but instead includes selectable variations in temperature gradient change.

Preferably, the temperature gradient modifier 100 produces the varied temperature gradients while the fluid 12 is flowing in the well. The temperature gradient modifier 100 could be located at the surface, at a subsea facility, in the well, or at any other location in keeping with the principles of the invention. A variety of examples of the temperature gradient modifier 100 are described below, but it should be clearly understood that the invention is not limited in any manner to the specific details of these examples, since any type of switchable temperature gradient modifier may be used without departing from the principles of the invention.

In one example, the temperature gradient modifier 100 could include the manifold 86 described above and illustrated in FIG. 6, with associated valves, sensors, etc. for variably mixing the fluid compositions 80, 82. More or less of selected ones of the fluid compositions 80, 82 could be mixed at the manifold 86 to produce different temperature gradients in the fluid composition 84. For example, the fluid composition 80 could be flowed through the manifold 86 without also flowing any of the fluid composition 82, thereby producing one temperature gradient, and then a valve could be opened to mix some of the fluid composition 82 with the fluid composition 80, thereby producing a different temperature gradient. It will be appreciated that various combinations or mixtures of the fluid compositions 80, 82 (including various proportions by weight or volume of each fluid composition 80, 82 in the fluid composition 84) may be produced by the temperature gradient modifier 100 to thereby produce different temperature gradients in the fluid 12 while the fluid is flowing in the well.

In another example, the temperature gradient modifier 100 could include valves, sensors, etc. for adding the fluid composition to the fluid 12, which fluid composition contacts the substance 76 and/or 78 deposited in the well as described above and depicted in FIG. 5. For example, the temperature gradient modifier 100 could be used to dispense the fluid composition which disperses or penetrates a coating on the substance 76, and/or the temperature gradient modifier could be used to dispense the fluid composition which contacts the substance to initiate the chemical reaction.

In another example, the temperature gradient modifier 100 could include valves, sensors, etc. to regulate the flow of the fluid compositions 80, 82, or the proportions of these fluid compositions, mixed downhole as described above and depicted in FIG. 7. Similarly, the temperature gradient modifier 100 could control the dispensing of the substance 76 and the fluid composition 90, or the proportions of these components, in the example described above and depicted in FIG. 8.

In other examples, the temperature gradient modifier 100 could be used to change one or more physical properties of the fluid 12 (or at least a rate of heat transfer between the fluid and the physical environment of the wellbore 14), such as density and/or specific heat (for example, by dispensing different proportions of different fluids and/or fluid types, by adding more or less solids content to a fluid, etc.), flow rate, friction pressure (for example, by varying a viscosity of the fluid, etc.), Joule-Thomson effect (for example, by adding more or less gas to the fluid, by varying a pressure drop through the temperature gradient modifier, etc.), otherwise increasing a temperature of the fluid (for example, by initiating an exothermic chemical reaction, using a heat source such as an electrical resistance heater or a heat exchanger, etc.), otherwise decreasing a temperature of the fluid (for example, by initiating an endothermic chemical reaction, using a heat sink such as a chiller or a heat exchanger, etc.), gas proportion (for example, by adding gas to the fluid composition, initiating a chemical reaction which causes gas to be generated in the fluid composition, etc.) viscosity (for example, by applying or varying a magnetic field in a magnetorheological fluid, by applying or varying an electric potential in an electrorheological fluid, etc.). Thus, it will be appreciated that any manner of modifying a physical property of the fluid 12 may be used to produce different temperature gradients in the fluid using the temperature gradient modifier 100.

It may now be fully appreciated that the variety of techniques described above can be used for producing varied temperature gradients within a single fluid composition, and for producing varied temperature gradients between different fluid compositions. The varied temperature gradients allow displacement of fluid along a wellbore to be monitored in real time. The varied temperature gradients may be produced in real time while the fluid is being flowed in the wellbore.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A method of tracking fluid displacement along a wellbore, the method comprising the steps of:

monitoring temperature in real time in the wellbore; and observing in real time a variation in temperature gradient between fluid compositions in the wellbore.

2. The method of claim 1, further comprising the steps of observing in real time the variation in temperature gradient at spaced apart locations as the fluid compositions displace through the wellbore, and determining a flow rate based at least in part on a distance between the locations, and a difference in time between observation of the variation in temperature gradient at the respective locations.

3. The method of claim 1, wherein the fluid compositions have at least one substantially different physical property.

4. The method of claim 3, wherein the physical property is specific heat.

5. The method of claim 3, wherein the physical property is density.

6. The method of claim 3, wherein the physical property is a product of specific heat and density.

7. The method of claim 1, wherein the fluid compositions have a substantially different rate of heat transfer with an environment of the wellbore.

8. The method of claim 7, wherein the different rate of heat transfer is due to different flow rates of the fluid compositions.

9. The method of claim 1, wherein a heat source produces the variation in temperature gradient in at least one of the fluid compositions.

10. The method of claim 9, wherein the heat source is an exothermic reaction in the wellbore.

11. The method of claim 1, wherein a heat sink produces the variation in temperature gradient in at least one of the fluid compositions.

12. The method of claim 11, wherein the heat sink is an endothermic reaction in the wellbore.

* * * * *